US006400273B1

(12) United States Patent
Bettine

(10) Patent No.: US 6,400,273 B1
(45) Date of Patent: Jun. 4, 2002

(54) EAS SYSTEM WITH WIDE EXIT COVERAGE AND REDUCED OVER-RANGE

(75) Inventor: Dale R. Bettine, Coral Springs, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/566,169

(22) Filed: May 5, 2000

(51) Int. Cl.[7] ..... G08B 13/14
(52) U.S. Cl. ..... 340/572.4; 340/572.7
(58) Field of Search ..... 340/572.4, 572.1, 340/572.7

(56) References Cited

U.S. PATENT DOCUMENTS 4,595,915 A * 6/1986 Close ..... 340/572
4,975,681 A 12/1990 Watkins et al. ..... 340/572
5,381,137 A * 1/1995 Ghaem et al. ..... 340/572
6,307,473 B1 * 10/2001 Zampini et al. ..... 340/572.1

* cited by examiner

*Primary Examiner*—Daniel J. Wu
*Assistant Examiner*—Sihong Huang
(74) *Attorney, Agent, or Firm*—Akerman Senterfitt

(57) ABSTRACT

System for preventing detection stationary identification marker in a detection zone of an electronic article surveillance system. The system includes a transmitter for transmitting an exciter pulse for exciting an identification marker, and a receiver system for receiving a characteristic response energy emitted by an identification marker in an inhibit field of the detection zone and in a main area of said detection zone. A comparator system is provided for generating an alarm condition when the characteristic response energy received in the main area exceeds the characteristic response energy received in the inhibit field by a predetermined threshold value.

20 Claims, 4 Drawing Sheets

EAS SYSTEM WITH WIDE EXIT COVERAGE AND REDUCED OVER-RANGE

CROSS-REFERENCE TO RELATED APPLICATIONS (Not Applicable)

BACKGROUND OF THE INVENTION

1. Field of the Invention

This invention relates to an electronic article surveillance (EAS) system and more specifically to EAS systems which generate a reduced number of false detection alarms.

2. Description of the Relevant Art

Electronic Article Surveillance (EAS) systems are detection systems that allow the identification of a marker or tag within a given detection region. EAS systems have many uses, but most often they are used as security systems for preventing shoplifting in stores or removal of property in office buildings. EAS systems come in many different forms and make use of a number of different technologies.

A typical EAS system includes an electronic detection unit, markers and/or tags, and a detacher or deactivator. The detection units can, for example, be formed as pedestal units, buried under floors, mounted on walls, or hung from ceilings. The detection units are usually placed in high traffic areas, such as entrances and exits of stores or office buildings. The markers and/or tags have special characteristics and are specifically designed to be affixed to or embedded in merchandise or other objects sought to be protected. When an active marker passes through a marker detection region, the EAS system sounds an alarm, a light is activated, and/or some other suitable alert devices are activated to indicate the removal of the marker from the proscribed area.

Common EAS systems operate using the same general principles using a transmitter and a receiver. Typically the transmitter is placed on one side of the detection region and the receiver is placed on the opposite side of the detection region. The transmitter produces a predetermined exciter signal in a marker detection region. In the case of a retail store, this detection region is usually formed at a checkout aisle or an exit. When an EAS marker enters the detection region, the marker has a characteristic response to the exciter signal which can be detected. For example, the marker may respond to the signal sent by the transmitter by using a simple semiconductor junction, a tuned circuit composed of an inductor and capacitor, soft magnetic strips or wires, or vibrating resonators. This characteristic response is subsequently detected by the receiver. By design, the characteristic response of the marker is distinctive and not likely to be created by natural circumstances.

EAS systems are often called upon for coverage of a large detection area, such as a mall store entrance. The mall store entrance can sometimes cover the width of the mall store itself. Such relatively large detection areas require special design considerations. For example, the EAS system used for coverage must be carefully designed to avoid any gaps through which a marker might pass through undetected, while simultaneously avoiding false alarming caused by markers attached to store inventory which may be displayed near the detection region. The condition in which the detection region extends into the confines of the store in this manner is called "over-range."

When there is over-range in an EAS system, markers attached to clothes or other goods within a store will produce the expected characteristic response and resulting false alarming. These false alarms, resulting from tags too close to the placement of the EAS system, cause problems within the store and generate unwanted service calls for tuning the EAS system.

In stores where the rental price per square foot is high, false alarms generated by over-ranging of the EAS system is problematic and expensive because it wastes valuable retail floor space. It is thus desirable to develop an EAS system that has the ability to adequately cover a wide exit area without the problems posed by over-ranging.

BRIEF SUMMARY OF THE INVENTION

It is an object of the present invention to provide an EAS system with a wide exit coverage area.

It is also an object of the present invention to provide an EAS system with reduced over-range.

It is further an object of the present invention to provide an EAS system with reduced false alarms.

It is an additional object of the present invention to provide an EAS system that requires a reduced number of service calls.

These and other objects of the present invention are achieve by a subject apparatus for detecting an identification marker in a detection area of an electronic article surveillance system. The system includes a transmitter for transmitting an exciter pulse for exciting an identification marker, and a receiver system for receiving a characteristic response energy emitted by an identification marker in an inhibit field of the detection zone and in a main area of said detection zone. A comparator is provided for generating an alarm condition when the characteristic response energy received in the main area exceeds the characteristic response energy received in the inhibit field by a predetermined threshold value. The apparatus according to claim 1, wherein said receiver system comprises at least one inhibit field antenna for receiving energy in said inhibit field and at least one main antenna for receiving energy in said main area.

According to one aspect, the system includes more than one inhibit field antennas and a more than one main field antennas. In this case, the energy in the inhibit field antennas is combined in an inhibit receiver channel and the energy in the main field antennas is combined in a main field receiver channel. According to another aspect of the invention, the inhibit field antennas can be located above and below the detection zone. Similarly, the main field antennas can be located above and below the detection zone. The transmitter antenna is positioned so that the exciter pulse will excite markers in the main field and the inhibit field. According to one embodiment, the transmitter can be located between the inhibit field antenna and the main field antenna.

The transmitter antenna can be a loop antenna or any other suitable design. By comparison, the inhibit field antenna and the main field antenna are preferably directional ferrite type antennas. However, other types of antennas such as a loop antenna may also be used for this purpose.

According to another aspect of the invention, a filter is provided for removing received characteristic response energy originating from markers which are stationary. This filter can be implemented as a time delay filter wherein the delay time applied is equivalent to an integer number of transmit cycles of the transmitter.

According to another aspect, the invention can include a method for detecting an identification marker in a detection zone of an electronic article surveillance system. The method includes the steps of transmitting an exciter pulse for exciting an identification marker, receiving a characteristic response energy emitted by an identification marker in an inhibit field of said detection zone or in a main area of said detection zone, and generating an alarm condition when the characteristic response energy received in the main area exceeds the characteristic response energy received in the inhibit field by a predetermined threshold value.

The method can further include the steps of providing one or more inhibit field antennas for receiving energy in the inhibit field and one or more main field antenna for receiving energy in the main area. If multiple main field and inhibit field antennas are used, the method can also include the step of combining in an inhibit receiver channel the energy received from the inhibit field antennas and combining in a main receiver channel energy from the main field antennas. According to one aspect of the method, the inhibit field antennas are preferably positioned above and below said detection zone. Similarly, the main field antennas can be positioned above and below said detection zone. The transmitter antenna is advantageously positioned in a location such that markers in both the main field and inhibit field will be excited. For example, the transmitter antenna may be located between the inhibit field antenna and the main field antenna.

The method can further include the step of removing characteristic response energy for markers which are stationary. This can be accomplished for example by passing the received characteristic response energy through a time delay filter. In that case, the delay time applied by the time delay filter should be equivalent to an integer number of transmit cycles of exciter pulses.

DETAILED DESCRIPTION OF THE INVENTION

Figure 1:
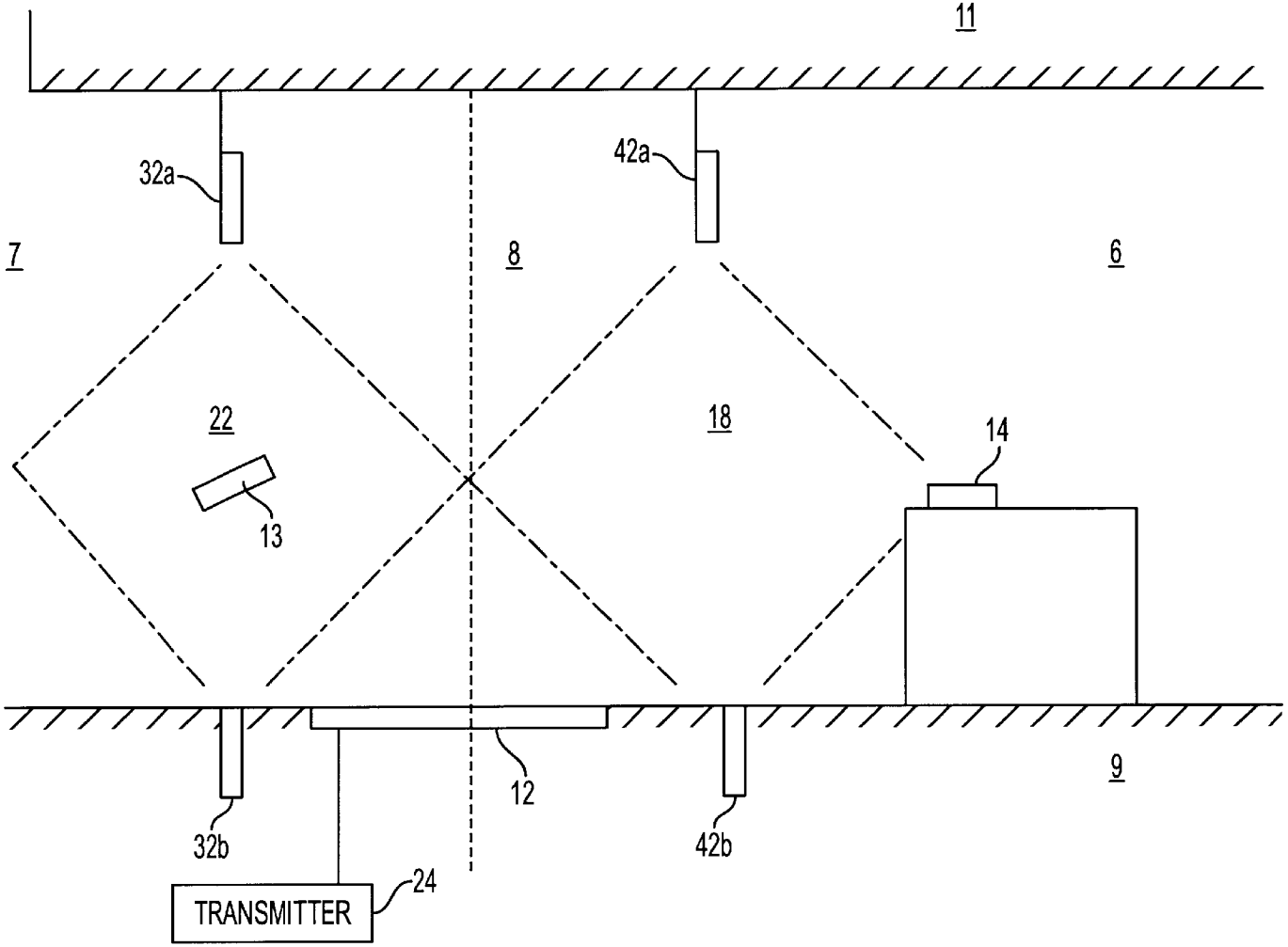
FIG. 1 shows an EAS system according to a preferred embodiment of hte present invention.

FIG. 1 shows an EAS system according to a preferred embodiment of the present invention. The system in FIG. 1 is shown in a typical retail installation wherein the EAS system is located at an entryway between the interior 6 and exterior 7 of the store premises. Within the entryway, a detection area 8 is defined wherein EAS tags are detected. The precise boundaries of the detection area will depend upon a variety of factors as shall hereinafter be explained in more detail.

Those skilled in the art will readily appreciate that while the invention is described herein in a retail context, it is not limited in this regard. In fact, the present invention can be used in any location or situation where the problem of EAS false alarming due to over-ranging is a concern.

Referring to FIG. 1, the EAS system includes transmitter 24 and antenna 12 for transmitting an exciter signal for exciting a remotely located EAS marker 13. A set of main field receiving antennas 32*a*, 32*b* and a set of inhibit field antennas 42*a*, 42*b* are advantageously positioned approximately as shown for receiving electromagnetic or RF energy associated with a characteristic response generated by the EAS markers. The receiving antennas 32*a* and 42*a* are preferably mounted within or somewhat below ceiling 11, and generally above the detection zone 8. Similarly, receiving antennas 32*b* and 42*b* are preferably mounted below the detection zone within or just above floor 9. However, the invention is not limited in this regard and the receiving antennas 32*a*, 32*b*, 42*a*, 42*b* can be arranged in any suitable manner so that distinct receiving zones are established in adjacent areas nearer and further from the store entryway as shown.

The present invention can be used with any of a variety of well known EAS detection schemes and its use is not intended to be limited to any single type of EAS marker system. Multiple types of EAS markers exist, the three most common types are EM(electro-magnetic), RF(Radio-Frequency), and AM(Acousto-Magnetic). The three different types only work within their respective detection systems. A variety of transmitter and receiver systems for exciting and detecting the presence of such markers are well known and are commercially available. Accordingly, the basic methods of exciting and detecting such markers will not be repeated here.

Referring again to FIG. 1, the transmitter 24 and antenna 12 can be any combination of equipment known in the art suitable for causing a characteristic response to occur in the particular type EAS marker which has been selected for use in the system. For example, in a preferred embodiment, the transmitter and antenna may be of the type used, for example, in the Floormax electronic article surveillance system produced by SENSORMATIC Electronics Corporation of Boca Raton, Florida which uses an acoustomagnetic type marker which exhibits a characteristic response when excited by a ultrasonic magnetic field pulse excitation signal. In this case, the antenna 12 is preferably a loop antenna and can be situated anywhere in or near the detection area 8, as long as the exciter pulse transmitted by the antenna 12 has enough power to excite an identification marker 13 when the identification marker 13 is located in the detection area 8. For example, the antenna 12 can be a pedestal type floor-standing transmitter or can be mounted in the ceiling or floor. In the present invention, it is preferred that the antenna 12 be mounted on or in the floor or ceiling.

Receiving antennas 32*a*, 32*b* and 42*a*, 42*b* are preferably antennas capable of picking up a characteristic response signal generated by an EAS marker selected for use with the system. In the case of an acoustomagnetic type marker, the receiver antennas 32*a*, 32*b* and 42*a*, 42*b* are preferably ferrite type antennas which have a directional response and are capable of receiving the characteristic signal generated by acoustomagnetic markers which are exposed to an excitation field. However, the invention is not limited in this regard and any other suitable antenna type may be used, provided it is capable of receiving energy associated with a characteristic marker response of the particular type EAS system for which the invention is to be implemented. Directional antennas are preferred for this purpose in order to provide better control over the shape of the receiver fields in which signals will be received.

According to a preferred embodiment, at least two antennas 32*a* and 32*b* are positioned at one end of the detection zone and at least two antennas 42*a*, 42*b* are positioned at the opposing end as shown. It should be noted however that the invention is not limited in this regard. For example more or fewer antennas can be used at each opposing end of the detection zone as may be required for a particular installation.

Figure 2:
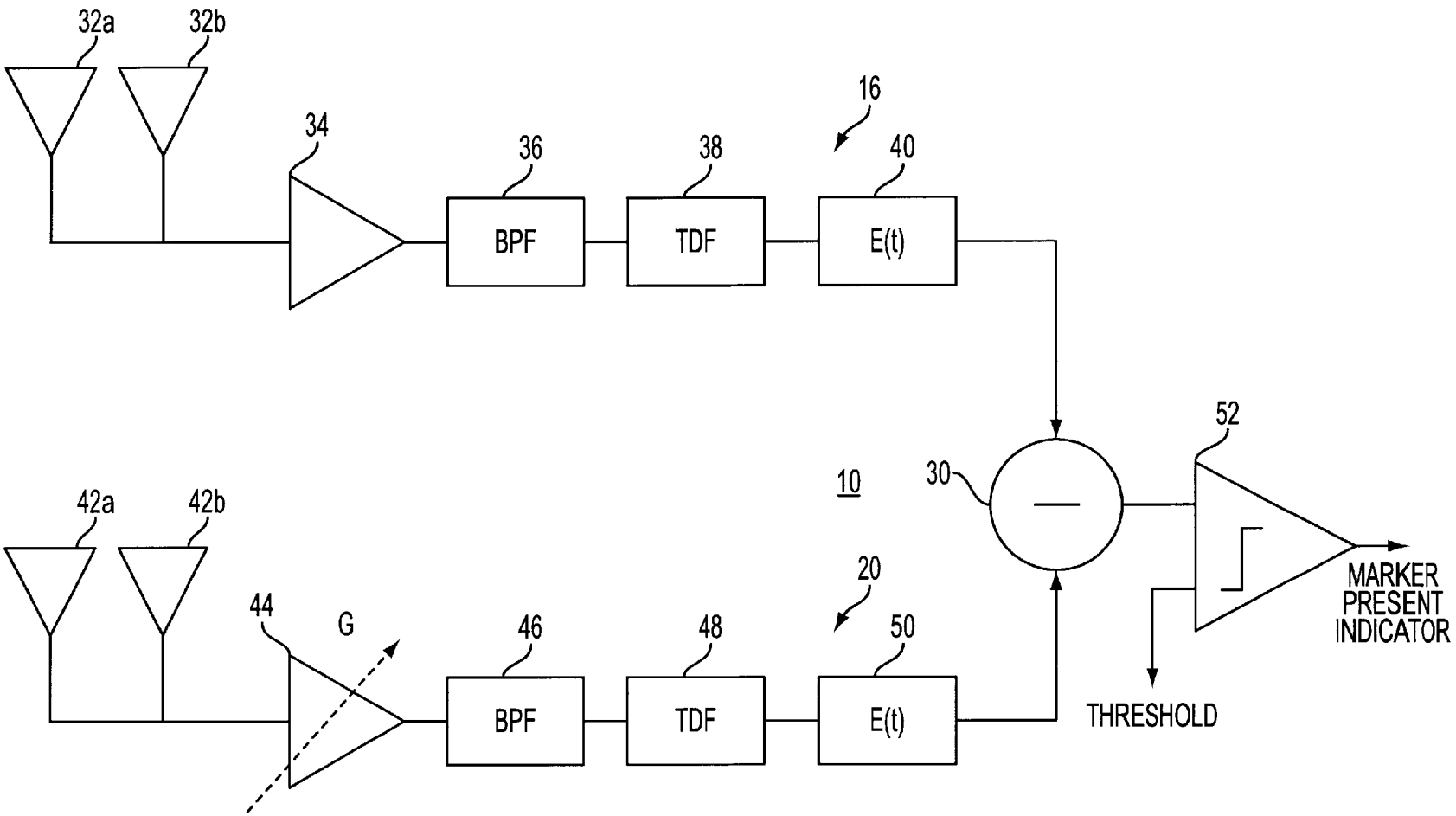
FIG. 2 shows receiver processing circuitry in block diagram for use with present invention.

FIG. 2 shows receiver processing circuitry in block diagram for use with the present invention. The receiver system 10 advantageously employs parallel receiver processing channels 16 and 20. Channels 16 and 20 operate in conjunction with transmitter 24 and antenna 12 to separately determine the total energy detected from EAS markers in the inhibit field detection zone 18 and in the main detection zone 22. For example, if conventional acoustomagnetic markers are to be used, the marker will begin to oscillate when brought within the detection zone 8 as a result of an ultrasonic magnetic field pulse generated by transmitter 24 and antenna 12. This pulse is typically transmitted for a short duration, for example 2 ms, and is repeated at a predetermined rate such as 20-millisecond intervals. Since the magnetic field pulse corresponds to the resonant frequency of the markers 13, 14 the marker begins to oscillate and continues to do so even after receiving the pulse. The oscillations, which typically last for about 5 ms, will generate a magnetic pulse. The magnetic pulse is then picked up by the main field antennas 32*a*, 32*b*, the inhibit field antennas 42*a*, 42*b* or in some cases by both sets of antennas. Suitable interface and timing circuitry (not shown) is employed to coordinate the operation of transmitter 24 and the receiver channels 16, 20 so that receiver channels 16 and 20 are enabled only during a predetermined time period during which a marker response is expected. Such interface and timing circuitry is well known in the art.

In a conventional EAS system the total energy received from EAS markers 13 or 14 in channel 16 or 20 would typically be computed, compared to a threshold and fed to an integrator. In such conventional systems, if the energy exceeds a predetermined threshold value then an alarm condition would be indicated. By comparison, in the present system the signals received by main field antennas 32*a* and 32*b* nearest an exterior 7 end of the detection zone 8 are summed together in receiver channel 16. Similarly, the signals received by inhibit field antennas 42*a* and 42*b* nearest an interior 6 end of the detection area are summed together in receiver channel 20. By using separate sets of antennas in these two areas, and independently processing signals received in each area in channels 16 and 20, two separate zones can be defined in the detection area 8. These two zones are the main detection zone 22 associated with antennas 32*a*, 32*b*, which is nearest the exit of the store, and the inhibit field detection zone 18 associated with antennas 42*a*, 42*b*, which is nearer to the retail selling floor of the store. Main detection zone 22 and inhibit field detection zone 18 are roughly delineated in FIG. 1 by a dashed line surrounding each area. However, it will be appreciated that the precise shape and limits of the inhibit field detection zone 18 and the main detection zone 22 shown in FIG. 1 will vary depending upon the selection of antennas, transmitter, markers, and receiver processing circuitry. Thus, the boundaries of zones 18 and 22 as shown are merely intended as examples and are not intended to limit the invention.

Referring to FIGS. 1 and 2, it can be seen that receiver channel 20 primarily receives energy from markers resident in the inhibit field detection zone 18 via inhibit field antennas 42*a* and 42*b*. For example, the receiver channel 20 can detect marker energy from an identification marker 14. In general, the receiver channel 20 may also detect some energy associated with a marker 13 located in the main detection zone 22. However, the antenna patterns defined by the inhibit field antennas 42*a* and 42*b* are preferably such that the energy received from a marker 13 in the main field will be negligible or at least substantially less as compared to the energy received from a marker 14 in the inhibit field 18.

Similarly, receiver channel 16 primarily receives energy from markers present in the main field detection zone 22. The antenna patterns defined by the main field antennas 32*a* and 32*b* in the main field are preferably configured such that the energy received from a marker 14 in the inhibit field 18 will be negligible or at least substantially less as compared to the energy received from a marker 13 in the main field 22. Those skilled in the art will appreciate that the amount of marker energy detected by antennas 32*a*, 32*b* and 42*a*, 42*b* is a function of multiple factors. Such factors can include, among other things, the antenna patterns and the proximity of the identification markers 13, 14 to each of the antennas.

Referring now to FIG. 2, it can be seen that receiver channels 16 and 20 are each preferably provided with suitable amplification circuitry 34, 44 and band pass filters 36, 46 as in conventional EAS systems as are well known in the art. The bandpass filters are designed to pass a marker characteristic response signal and to block out of band signals. The output of bandpass filters 36, 46 are coupled to time delay filters 38, 48 which in turn are coupled to signal processors 40, 50. Signal processors 40, 50 are provided for determining a total amount of received energy in each receiver channel 16, 20 each time such channels are enabled for detecting a characteristic marker response. The outputs of signal processors 40, 50 are preferably coupled to a difference amplifier 30 for determining a difference signal which represents the relative difference between the energy in each of channels 16 and 20. The output of difference amplifier 30 is coupled to a comparator 52 which compares the difference signal to a predetermined threshold. When the threshold is exceeded, the comparator 52 generates a marker present signal. This marker present signal can then be processed in accordance with conventional EAS system practices.

The present invention is intended to eliminate false alarming due to the presence of EAS marker such as marker 14 which is displayed within the confines of the store interior 6, but which is relatively close to an exit where a detection zone 8 has been established. When a single marker 14 which is present in the inhibit field detection zone 18 emits its characteristic response signal, the total energy received by main field antennas 32*a*, 32*b* will be less than the energy received by inhibit field antennas 42*a*, 42*b*. The signals received by each set of antennas are respectively processed by channels 16 and 20 and coupled to difference amplifier 30. The resultant output from inhibit field channel 20 will be greater than the output of main field channel 16. This is an indication that the EAS marker is in the store and the system should inhibit any alarm. This alarm inhibit is accomplished by subtracting the energy in the inhibit field channel 20 from the main field channel 16 in the difference amplifier 30 such that the signal level coupled to the comparator 52 does not exceed the preset threshold.

By comparison, when a marker such as marker 13 is only present in the main field detection zone 22, the energy in the main channel 16 should generally be larger than the energy in the inhibit field channel 20. Under these conditions, the output of difference amplifier 30 will exceed the threshold which has been set for comparator 52 and a marker present signal will be generated.

According to a preferred embodiment, amplifier circuitry 44 for the inhibit field channel 16 is configured to have an adjustable gain. The adjustable gain amplifier circuitry is used to compensate for gain variations between receiver channels 16, 20 and to compensate for differences in marker signal levels caused by variations in transmitter antenna placement. In effect, the adjustable gain amplifier 44 can also be used to move the inhibit/alarm zone either closer or further away from the interior of the store 6. The threshold which is set for comparator 52 is similarly used to determine how sensitive the system will be and to determine how large a difference signal from difference amplifier 30 is required in order to create an alarm indication.

Ignoring for a moment the time delay filters 38 and 48, the receiver system could be described by the following equation:

$$E1(t)-\{G\times E2(t)\}>\text{Threshold}$$

Where E1(t) represents the total energy in the main field, E2(t) represents the total energy in the inhibit field, and G is the additional gain applied to inhibit field channel by adjustable gain amplifier 44 relative to amplifier 34. The above model works well for a single marker either in the inhibit field 18 or in the main field 22. However, when there are multiple tags 14 placed in the inhibit field, the cumulative energy E2(t) of these multiple markers will be relatively large. In fact, the cumulative energy E2(t) may potentially exceed the energy of a tag 13 in the main field detection zone 22 which is leaving the store. This would have the undesirable effect of inhibiting an alarm condition when an alarm should be indicated. The time delay filters 38, 40 are intended to avoid this error condition.

Figure 3:
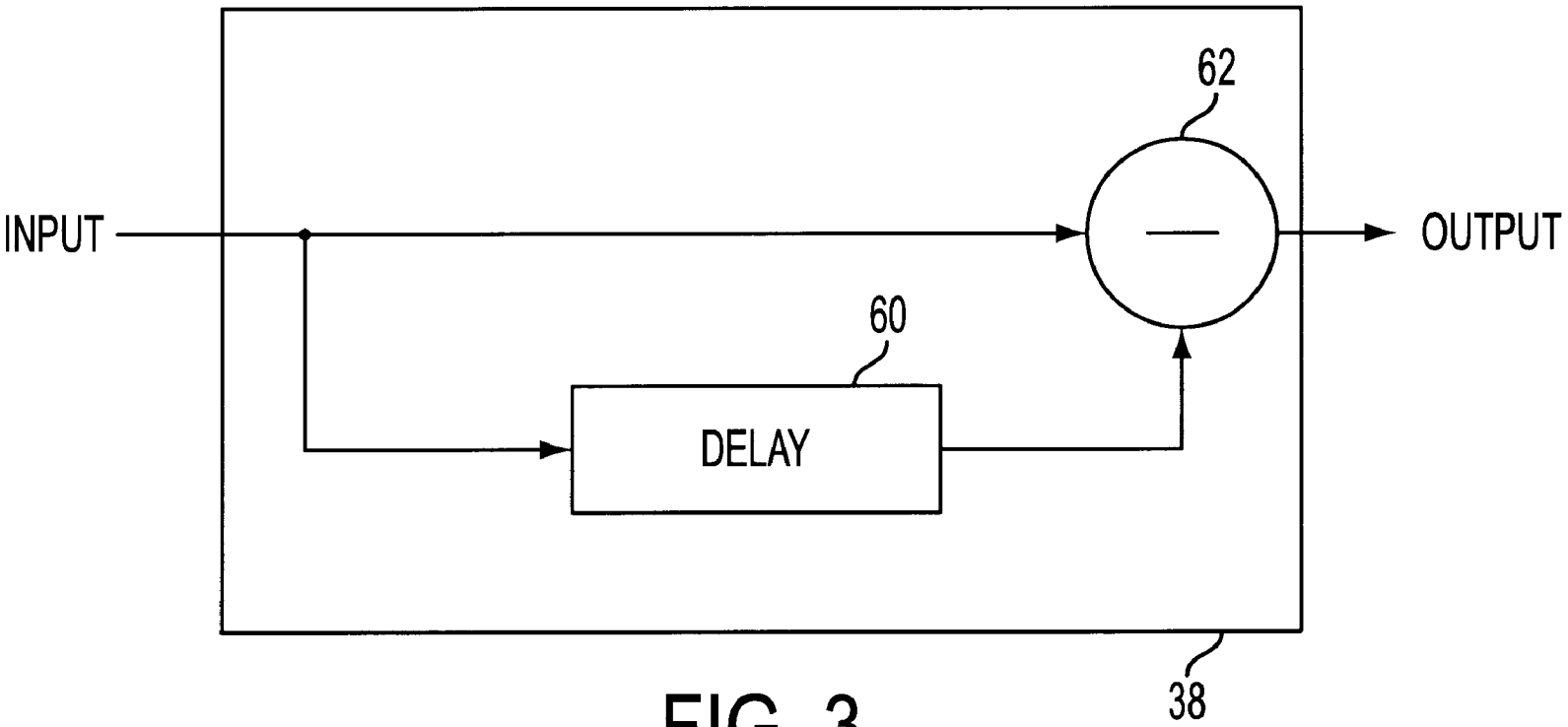
FIG. 3 illustrates one possible implementation of a time delay filter.

The time delay filters 38, 40 are intended to cancel out the effect of stationary markers, such as marker 14 attached to display merchandise in the inhibit field 18 and to prevent such stationary inhibit field markers from desensitizing the system. FIG. 3 is a block diagram which shows the operation of time delay filter 38, it being understood that time delay filter 40 is preferably similarly arranged. As shown in FIG. 3, signals received in the time delay filter are preferably processed in two parallel processing paths within the filter as shown. One path of the filter is coupled to the input of a difference amplifier 62. A second filter path is coupled to the input of a signal delay device 60 such as a SAW device, delay line or digital delay circuitry. Those skilled in the art will readily appreciate that this delay could also be implemented using suitable signal processing software in a digital signal processor. The time delay which is provided by delay device 60 is preferably chosen to be equivalent to the time associated with an integer number of transmit cycles for transmitter 24. The purpose for this integer delay is to ensure that the delayed response signal is aligned in time with a subsequent non-delayed response signal produced by the same marker when such signals are processed by the difference amplifier 62. This time delay is preferably about 500 msec which is equal to about 25 transmit cycles. In any case the time delay is preferably substantially less than the time required for a marker to be carried through the detection zone so as not to unduly delay an indication of alarm condition.

Since a marker that is stationary will have the same detected response from transmit cycle to transmit cycle, the characteristic response signal generated by such a marker will subtract to zero at the output of time delay filter 38 after an integer number of transmit cycles equal to the time delay of delay device 60. By comparison, a marker which is moving will have a detected response which is generally varying in signal amplitude as the marker moves through the detection zone 8 and will consequently be allowed to pass through the time delay filter 38.

More particularly, by adding this integer time delay, the marker energy signal passed to the difference amplifier 62 by the delay device 60 will arrive at the difference amplifier 62 at approximately the same time as response energy from the same marker caused by a second or subsequent exciter pulse. If the second marker response energy is equivalent to the earlier marker energy signal passed by the delay device 60 to the difference amplifier 62, then the identification marker from which the marker energy signal is emanating is stationary. If the second response energy is lesser or greater than the marker energy, then the identification marker 14 is moving within the detection area 8.

FIG. 3 illustrates one possible implementation of a time delay filter. However, it should be noted that the time delay filters 38, 48 can be any filter capable of filtering out responses caused by stationary markers. Similarly, it will be appreciated by those skilled in the art that the receiver system shown in FIGS. 1–3 can be implemented using any of a variety of well known analog and digital design techniques for implementing electronic receivers. For example, in place of two discrete sets of analog component channels, each receiver channel can be provided with suitable digital signal processing circuitry to perform the signal processing, time delay, difference functions, and comparator functions.

Figure 4:
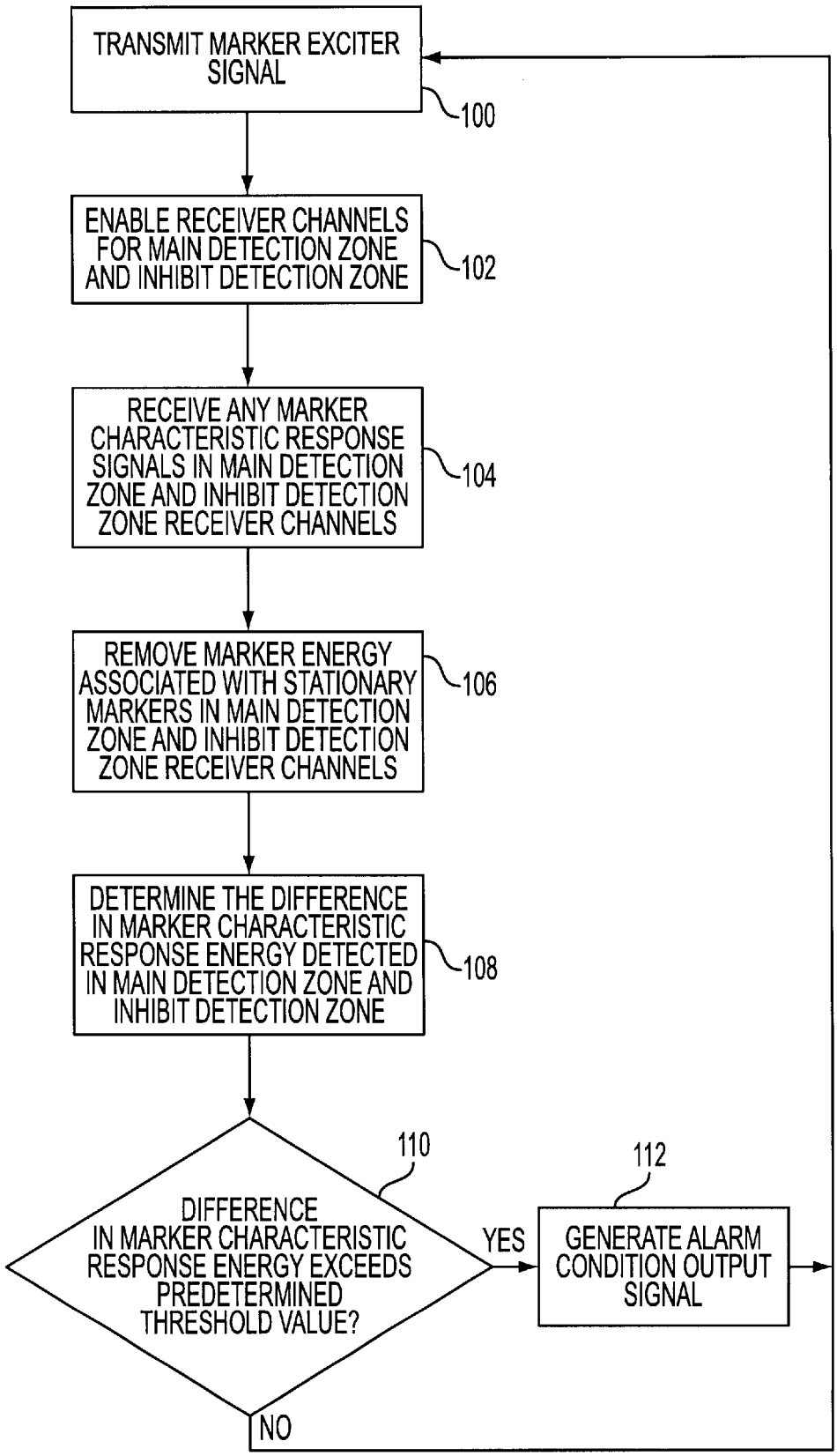
FIG. 4 is a flow chart illustrating a method for monitoring a wide coverage area with reduced over-range, according to the present invention.

FIG. 4 is a flow chart illustrating a method for monitoring a wide coverage area with reduced over-range, according to the present invention. This method begins in step 100 by transmitting an exciter pulse using transmitter 24 and antenna 12 for exciting a remotely located identification marker as shown in FIG. 1. In step 102, receiver 10 is enabled so that energy associated with a characteristic response of a marker 13, 14 can be received from the main detection zone 22 and/or the inhibit detection zone 18.

In step 104, the energy in each of the main detection zone 22 and inhibit field detection zone 18 is received, for example, as described relative to FIG. 2. In step 106, the system removes from each receive channel 16, 20 energy associated with stationary markers. This can be performed as described in connection with FIG. 3 by using a delay filter, or by any other suitable algorithm that may be devised for this purpose.

In step 108, the system determines the difference in marker characteristic response energy detected in the main detection zone as compared to the inhibit field detection zone. In step 110, a determination is made as to whether the energy detected in the main detection zone is sufficiently larger than the energy detected in the inhibit field so as to exceed a predetermined threshold value. If not, the system simply repeats the excitation and detection cycle by returning to step 100. However, if the marker characteristic energy exceeds a predetermined threshold, then the system proceeds to step 112 where an alarm condition is generated. The alarm condition can be integrated over a number of excitation cycles to prevent false alarming.

What is claimed is:

1. An apparatus for detecting an identification marker in a detection zone of an electronic article surveillance system, comprising:

a transmitter for transmitting an exciter pulse for exciting an identification marker;

a receiver system for receiving a characteristic response energy emitted by any said identification marker in an inhibit field of said detection zone and in a main area of said detection zone; and a comparator for generating an alarm condition when the characteristic response energy received in said main area exceeds said characteristic response energy received in said inhibit field by a predetermined threshold value.

2. The apparatus according to claim 1, wherein said receiver system comprises at least one inhibit field antenna for receiving energy in said inhibit field and at least one main antenna for receiving energy in said main area.

3. The apparatus according to claim 2 wherein a plurality of inhibit field antennas are provided and a plurality of main field antennas are provided, and the energy in said inhibit field antennas is combined in an inhibit receiver channel and the energy in the main field antennas is combined in a main field receiver channel.

4. The apparatus according to claim 3, wherein said plurality of inhibit field antennas are located above and below the detection zone.

5. The apparatus according to claim 3, wherein said plurality of main field antennas are located above and below the detection zone.

6. The apparatus according to claim 2 wherein said transmitter antenna is located between said inhibit field antenna and said main field antenna.

7. The apparatus according to claim 2, wherein said transmitter antenna is a loop antenna.

8. The apparatus according to claim 2, wherein at least one of said inhibit field antenna and said main field antenna is selected from the group consisting of a directional ferrite type antenna and a loop antenna.

9. The apparatus according to claim 1, further comprising a filter for removing from said receiver system characteristic response energy for markers which are stationary.

10. The apparatus according to claim 9 wherein said filter is a time delay filter.

11. The apparatus according to claim 10, wherein said delay time applied by said time delay filter is equivalent to an integer number of transmit cycles of said transmitter.

12. An method for detecting an identification marker in a detection zone of an electronic article surveillance system, comprising:

transmitting an exciter pulse for exciting an identification marker;

receiving a characteristic response energy emitted by any said identification marker in an inhibit field of said detection zone and in a main area of said detection zone; and generating an alarm condition when the characteristic response energy received in said main area exceeds said characteristic response energy received in said inhibit field by a predetermined threshold value.

13. The method according to claim 12, further comprising the steps of providing at least one inhibit field antenna for receiving energy in said inhibit field and at least one main field antenna for receiving energy in said main area.

14. The method according to claim 13 further comprising the step of combining in an inhibit receiver channel the energy received from a plurality of said inhibit field antennas and combining a main receiver channel energy from a plurality of said main field antennas.

15. The method according to claim 14, further comprising the step of positioning said plurality of inhibit field antennas above and below said detection zone.

16. The method according to claim 14, further comprising the step of positioning said plurality of main field antennas above and below said detection zone.

17. The method according to claim 13 further comprising the step of positioning said transmitter antenna between said inhibit field antenna and said main field antenna.

18. The method according to claim 12, further comprising the step of removing from characteristic response energy for markers which are stationary.

19. The method according to claim 18 further comprising the step of removing from characteristic response energy for markers which are stationary by passing said received characteristic response energy through a time delay filter.

20. The apparatus according to claim 19 wherein said delay time applied by said time delay filter is equivalent to an integer number of transmit cycles of said exciter pulse.

* * * * *